United States Patent [19]

Beauchot

[11] Patent Number: 4,476,652

[45] Date of Patent: Oct. 16, 1984

[54] DEVICE FOR SUSPENDING A SLIDABLE SEALED DOOR

[75] Inventor: Pierre Beauchot, Blaincourt sur Precy, France

[73] Assignee: Fermod, France

[21] Appl. No.: 402,331

[22] Filed: Jul. 27, 1982

[30] Foreign Application Priority Data

Aug. 5, 1981 [FR] France ..... 81 15209

[51] Int. Cl.[3] ..... E05D 15/56

[52] U.S. Cl. ..... 49/235; 49/410; 16/99

[58] Field of Search ..... 49/234, 235, 409–411; 16/99, 105

[56] References Cited

U.S. PATENT DOCUMENTS 2,740,168 4/1956 Wright ..... 49/235 X

FOREIGN PATENT DOCUMENTS 1572638 7/1980 United Kingdom ..... 49/235

*Primary Examiner*—Kenneth Downey

*Attorney, Agent, or Firm*—Burns, Doane, Swecker & Mathis

[57] ABSTRACT

The device comprises a guide rail (1) having a cross-section in the general shape of a C and fixed to a wall (M) and defining two guide surfaces (8, 9). One of the guide surfaces (8) has a notch (2) with which cooperates at least one roller ($G_1$) or other rolling or sliding element carried by the door support means (13). The other guide surface cooperates with at least one roller ($G_2$) or other rolling or sliding element carried by a pivotal arm (21) connected to the door (P). The or each pivotal arm is disposed completely within the rail (1) and operates under compressive stress.

9 Claims, 5 Drawing Figures

DEVICE FOR SUSPENDING A SLIDABLE SEALED DOOR

DESCRIPTION

The present invention relates to slidable sealed doors and the suspension devices therefor, such doors being employed, in particular, for enclosures in which a given temperature and/or atmosphere must be maintained.

A suspension device of a slidable sealed door of simple construction and cheap permitting the obtainment of a door closing force which is substantially increased relative to that already obtained in systems of the prior art, is described in the French patent application No. 72 42 370. In this device, the door support means is essentially formed by an arm under tensile stress whose first end cooperates with a first guide means rigid with the wall, with respect to which it is movable angularly and in translation, the other end of the arm supporting the door proper on a pivotable manner.

The device also comprises a second guide rail fixed to the wall whose guide surface defines at least one ramp or a notch with which cooperates at least one roller or rolling or sliding element carried by the door support means.

Further, in this device the angle between the arm and the horizontal permits, when the roller located on the second guide rail drops into a notch, the production of a force of application of the door on the door frame equal to 1.4 to 1.7 times the weight of the door, which is of course advantageous in the obtainment of a good seal.

An improvement in this device is disclosed in the certificate of addition U.S. Pat. No. 76 24 558.

This improvement consists in replacing the two guide rails by a C-section member fixed against the wall, the edge of the lower flange of the C forming the surface of said second guide rail and the upper part of the C defining a rolling surface facing inwardly of the section member and constituting said first guide rail. This arrangement markedly simplifies the manufacture of the suspension device and consequently reduces the cost.

However improved this last mentioned device may be, it has however the following drawbacks. First of all, the position of the end roller of the arm which is always above that of the roller which rolls along the lower flange of the C, imposes a distance in the upward direction which is appreciable between the edge of the lower flange of the C and its upper part. This results in a lack of compactness of the assembly comprising the rollers, the arm and the C-section member which has for consequence to render excessively large the space which must be provided for the section member above the sealed member, the reservation of this space being of course to the detriment of the available height for the door itself.

Secondly, the angle of inclination between the arm and the horizontal, when the door is in the open position, increases by an amount $\alpha$ when the door moves to the closed position and this limits the maximum effectiveness of the closing force to that obtained for the residual angle.

Lastly, as the pivotal mounting of the arm on the door is located outside the C-section member, the suspension rollers are exposed to dust, which requires the mounting of a protecting outer section member or case which correspondingly increases the cost of the assembly.

An object of the present invention is to introduce improvements in the aforementioned devices so as to provide a more compact device which has a greater closing effectiveness and an improved exterior appearance, while reducing its cost.

According to the invention, there is provided a device for suspending a slidable sealed door comprising a guide rail having a generally C-shaped cross-section and fixed to a wall and defining two guide surfaces, one of said surfaces comprising at least one ramp or a notch with which cooperates at least one roller or other rolling or sliding element carried by support means for the door, the other surface cooperating with at least one roller or other rolling or sliding element carried by a pivotable arm connected to the door, wherein the or each pivotable arm is disposed completely within the C-section rail and operates under compressive stress.

According to another feature of the invention, the ends of the C formed by the upper and lower edge portions of the C-section member are disposed in a roughly horizontal plane and the guide surfaces located at said ends of the C are roughly perpendicular to each other.

According to a preferred embodiment of the invention, the door is mounted on brackets connected in a pivotal manner to the compression arm and supporting the or each rolling or sliding element which cooperates with the first guide surface.

Preferably, the compression arms are inclined to the horizontal at an angle of less than 45° when the door is in the closed position.

A better understanding of the invention will be had from the ensuing description which is given merely by way of example with reference to the accompanying drawings in which.

Figure 2A:
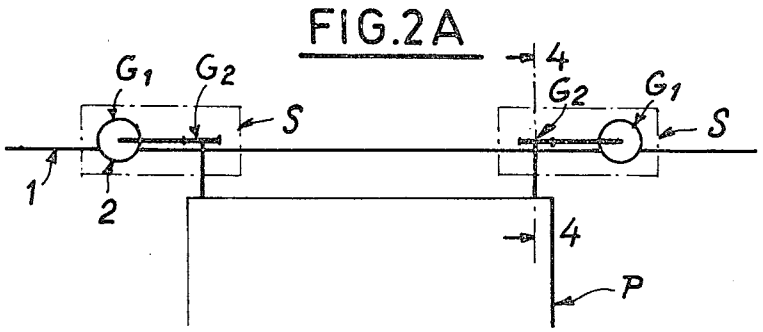
FIGS. 2A and 2B are diagrammatic views of the positions of the door relative to the guide rail in the respectively closed and open positions.
Figure 2B:
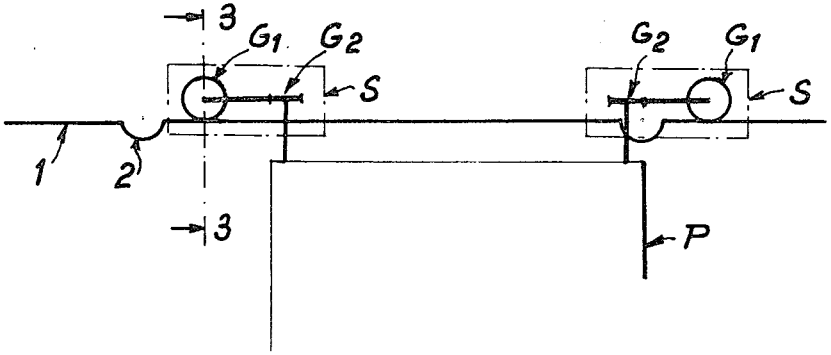
Figure 1:
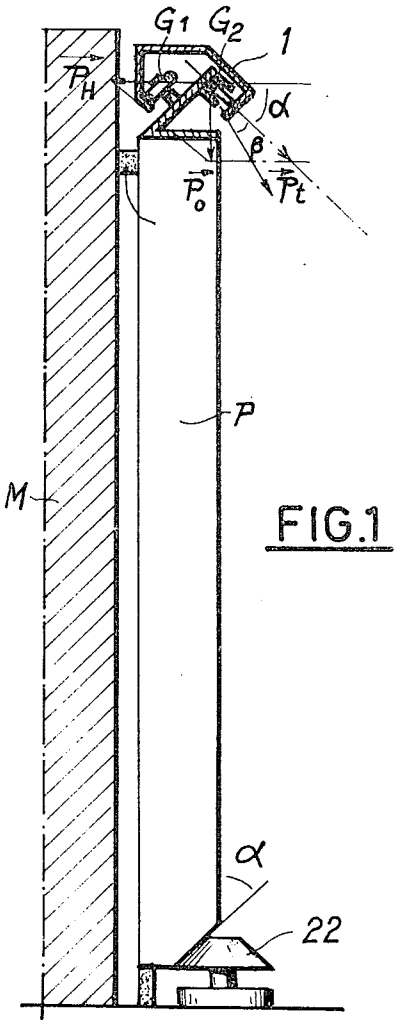
FIG. 1 is a diagrammatic view of the relationship between the forces when the door is balanced on the guide rail.

The door P and its suspension devices are shown diagrammatically in FIGS. 1 and 2A, 2B. In these Figures, the door P is suspended from a guide rail 1 through suspension devices S each of which comprises two rollers $G_1$ and $G_2$ which ensure the longitudinal displacement of the door by a rolling thereof along the guide rail. Formed in the guide rail are notches 2 into which the rollers $G_1$ drop when the door is in the closed position shown in FIG. 2A.

Figure 4:
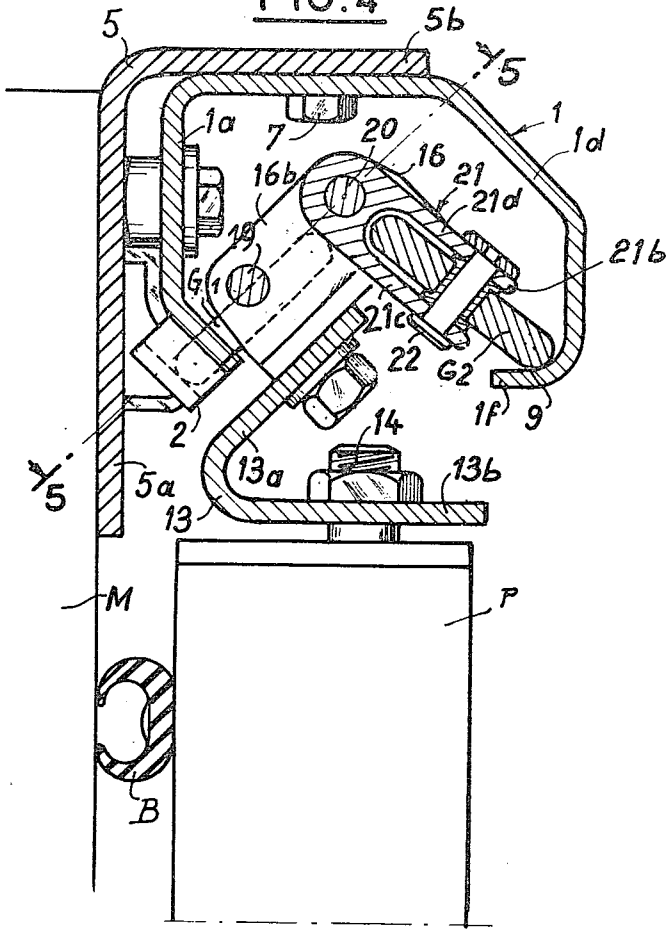
FIG. 4 is a sectional view of the suspension device taken along line 4—4 of FIG. 2A.
Figure 3:
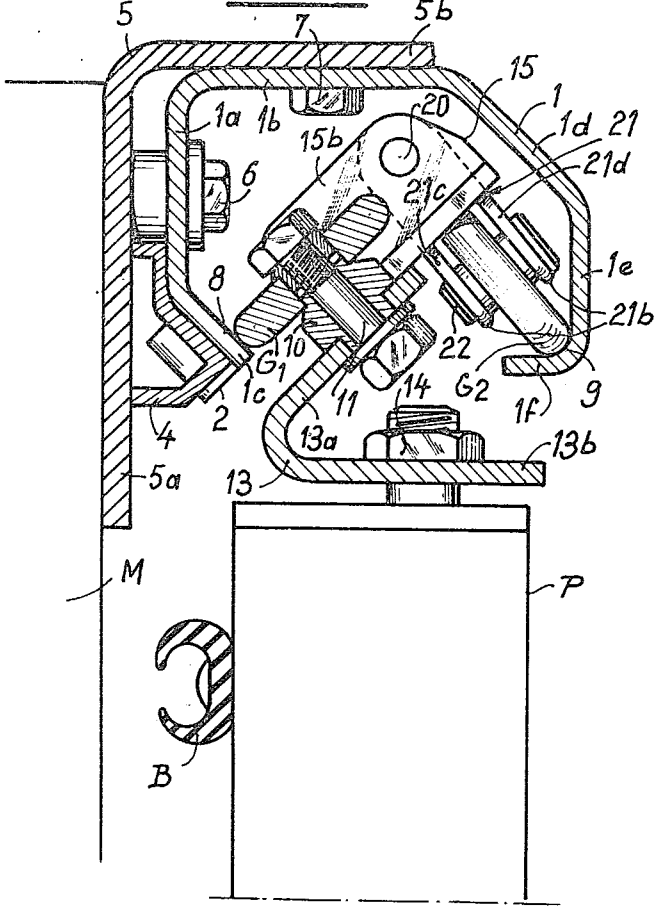
FIG. 3 is a sectional view of the suspension device taken along line 3—3 of FIG. 2B.
Figure 5:
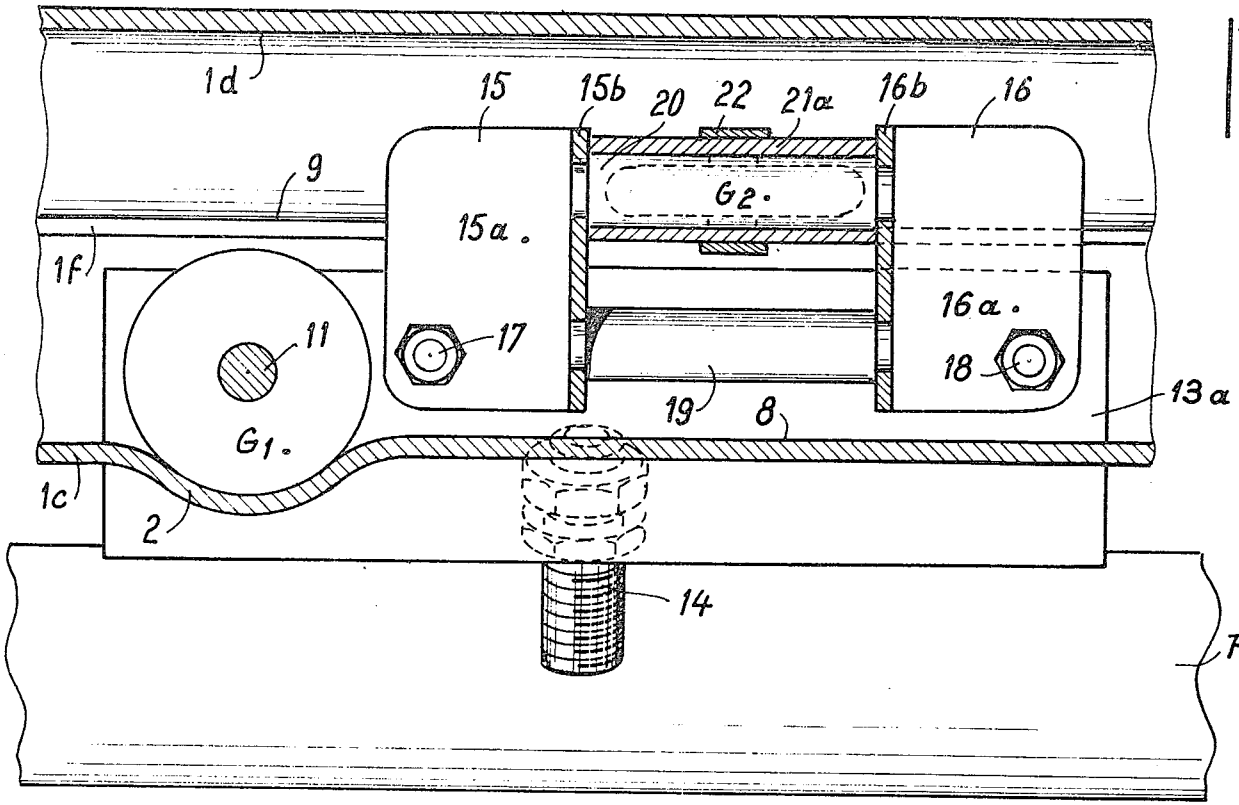
FIG. 5 is a sectional view of the suspension device taken along line 5—5 of FIG. 4.

The details of the construction of each suspension device S and its cooperation with the door P and the guide rail are shown in FIGS. 3 to 5. The door is shown in the open position in FIG. 3. It is shown in the closed position, bearing against its sealing members B, in FIG. 4.

In these Figures, the guide rail 1 is formed by a section member whose section is in the shape of an inclined C which is downwardly open and maintained applied against the wall M by a first flange 1*a* through a bracket 4 and a flange 5a of an L-section member 5, the assembly being clamped together by a screw 6 which extends therethrough and is screwed into the wall M.

The guide rail 1 is also fixed by its upper web 1b to the upper flange 5b of the L-section member 5 by a fixing means 7 in such manner that the web 1b is planar and roughly horizontal. The free end 1c of the flange 1a of the rail 1 is bent obliquely of the C and makes an angle of about 45° with the horizontal so as to form a planar guide surface 8 inside the C-section member.

The guide surface 8 and the flange 1c also have at two predetermined places the notches 2 which can be seen in FIG. 4. The flange of the C opposed to the wall M comprises two portions 1d and 1e which make therebetween an obtuse angle. The portion 1d is adjacent to the web 1b. The portion 1e extends in a direction parallel to the flange 1a and terminates at its free end in a flange 1f which extends inwardly of the section member, this flange defining in the corner formed internally with the adjacent portion 1e a rolling surface 9 having a section in the shape of an arc of a circle located inside the guide rail 1 and thus constituting a second guide surface whose mean plane is roughly perpendicular to the guide surface 8. Rolling along the guide surface 8 is the roller $G_1$ which is freely rotatable on a collar 10 which is fixed by a bolt 11 to an oblique upper flange 13a of a V-section member 13. The lower flange 13b of the section member 13 is roughly horizontal and fixed to the upper edge portion of the door P by fixing means 14.

The oblique flange 13a also supports a support device for the roller $G_2$ comprising two L-section members 15 and 16 (FIG. 5) having perpendicular flanges. The flanges 15a and 16a of these L-section members are secured to the flange 13a by clamping means 17 and 18. The other flanges 15b and 16b are maintained spaced apart and parallel to each other by a spacer member 19 and a rod 20, the longitudinal axes of the spacer member 19 and the rod 20 being disposed parallel to the longitudinal axis of the guide rail 1. Pivotally mounted on the rod 20 is the web 21a of a compression arm 21 in the shape of U having two branches 21b and 21c between which the roller $G_2$ is journalled on a pin 22 perpendicular to the rod 20. The roller $G_2$ bears against the rolling surface 9 and has a toric peripheral surface which allows an angular displacement of the axis of the roller $G_2$ with respect to the surface 9. The rod 20 is located above the rollers $G_1$ and $G_2$ close to the web 1b of the C. The mean planes of the two rollers intersect in the vicinity of this rod and are inclined at roughly the same angle to the vertical.

The devie operates in the following manner:

When the door is in a position of translation, i.e. in a partly open or completely open position, the device has the configuration shown in FIG. 3. When the door is moved in translation, the rollers $G_1$, $G_2$ respectively roll along their guide surfaces 8 and 9. When the door reaches the vicinity of its closed position or its closed position, the rollers $G_1$ drop into the notches 2 of the flange 1a and this shifts the door towards the ground and towards the wall. In the course of this displacement, the angle made between the mean planes of the rollers $G_1$ and $G_2$ increases by a value $\alpha$ of about 15° and assumes the position shown in FG. 4 where it can be seen that the rollers $G_2$ have tilted about their bearing point on the rolling surface 9.

With reference to FIG. 1, it is possible to examine the analysis of the forces when the door is in the closed position. The weight Po of the door transmitted by the section member 13 is applied on the rod 20. Its line of action from this rod passes between the rollers $G_1$ and $G_2$. If it is assumed that the rolling surface 8 practically does not intervene in the transmission of the forces, which is in fact the case in reality owing to the fact that the sealing members B bear against the wall M, the weight Po of the door can be divided into a component $P_T$ which extends along the compression arm 21 and a horizontal component $P_H$. FIG. 1 shows that if $\beta$ represents the angle that the compression arm makes with respect to the horizontal when the door is in the closed position, the horizontal component $P_H$ of the weight, which is equal to Po/tan $\beta$, is greater than Po if care is taken to chose an angle $\beta$ less than 45°.

In its lower part, the door is guided by the rollers 22a of conical shape and vertical axis whose generatrix the closest to the wall is inclined relative to the vertical at the aforementioned angle $\beta$. In this way, the reaction exerted by the wall on the lower part of the door is absorbed by the lower guide rollers.

With reference again to the device shown in FIGS. 3 and 4, the compression arm 21 makes an angle $\beta$ with the horizontal when the door is in the closed position, and an angle $\alpha+\beta$ when the door is in the open position. The angle of inclination of the compression arm with respect to the horizontal is therefore minimum when the door is in the closed position, and this situation is of course advantageous as concerns a greater effectiveness of the door closing force. It will be observed that, with the device of the invention as described, it is always possible to obtain any values of $\beta$ between 0° and 45° by, for example, increasing the distance between the two flanges of the C and/or raising the flange 1f of the same section member.

Having now described my invention what I claim as new and desire to secure by Letters Patent is:

1. In a device for suspending a slidable sealed door for a wall defining a doorway, said device comprising a guide rail having a cross-section in the general shape of a C for fixing to said wall and defining two guide surfaces along which surfaces the door is movable between an opening position and a closing position relative to said doorway, a first of said guide surfaces having a notch, door support means mounted on the door, at least one first rolling or sliding element carried by the door support means and cooperable with the first guide surface in a first contact region, at least one pivotal arm connected to the door and pivotable about a pivot axis substantially parallel to said guide surfaces, at least one second rolling or sliding element carried by the at least one pivotal arm, a second of said guide surfaces cooperating with said at least one second element in a second contact region, said first element being adapted to enter said notch when the door is moved to said closing position for lowering the position of said pivot axis and pivoting said at least one pivotal arm and thereby displacing the door toward said wall for compressing sealing means between the door and said wall; the improvement wherein the at least one pivotal arm is disposed completely within the C-section rail and said pivot axis is located above said contact regions in positions of the door other than said closing position thereof and is located no lower than said contact regions in said closing position of the door.

2. A device according to claim 1, wherein the guide surfaces are substantially perpendicular to each other.

3. A device according to claim 1, wherein the at least one pivotal arm is inclined to the horizontal at an angle of less than 45° when the door is in said closing position.

4. A device according to any one of the claims 1 to 3, wherein the guide surfaces are located on the same level in a roughly horizontal plane.

5. A device according to claim 1, wherein the at least one pivotal arm comprises a first end portion pivotally mounted on a first rod connected to the door, the first rod having a longitudinal axis defining said pivot axis, the at least one pivotal arm having a second end portion provided with a second rod on which is rotatively mounted said second element, said second guide surface being devoid of notches.

6. A device according to claim 5, wherein two L-section members fixed to opposed ends of the first rod connect the first rod to the door.

7. In a device for suspending a slidable sealed door for a wall defining a doorway, said device comprising a guide rail having a cross-section in the general shape of a C for fixing to said wall and defining two guide surfaces along which surfaces the door is movable between an opening position and a closing position relative to said doorway, a first of said guide surfaces having a notch, door support means mounted on the door, at least one first rolling or sliding element carried by the door support means and cooperable with the first guide surface, at least one pivotal arm connected to the door and pivotable about a pivot axis substantially parallel to said guide surfaces, at least one second rolling or sliding element carried by the at least one pivotal arm, a second of said guide surfaces cooperating with said at least one second element, said first element being adapted to enter said notch when the door is moved to said closing position for lowering the position of said pivot axis and pivoting said at least one pivotal arm and thereby displacing the door toward said wall for compressing sealing means between the door and said wall; the improvement wherein the at least one pivotal arm is disposed completely within the C-section rail and operates under compressive stress and is inclined to the horizontal at an angle of less than 45°, when the door is in said closing position, the guide surfaces are located on the same level in a roughly horizontal plane and the pivot axis of the at least one pivotal arm is located above the rollers, the at least one pivotal arm comprises a first end portion pivotally mounted on a first rod connected to the door, the first rod having a longitudinal axis defining said pivot axis, the at least one pivotal arm having a second end portion provided with a second rod on which is rotatively mounted said second element, said second guide surface being devoid of notches, and the C-section guide rail being downwardly open and having a flange by which flange the guide rail is to be fixed to the wall.

8. A device according to claim 7, wherein said flange for fixing to the wall bears against a first flange of an L-section member, said flange for fixing to the wall and the flange of the L-section member being clamped by clamping means for fixing in the wall.

9. A device according to claim 8, wherein the web of the guide rail is also fixed to a second flange of said L-section member in such manner as to be disposed in a substantially horizontal plane.

* * * * *